US005468081A

United States Patent [19]

Cane et al.

[11] Patent Number: 5,468,081

[45] Date of Patent: Nov. 21, 1995

[54] TAPE CUTTING APPARATUS

[75] Inventors: Michael R. Cane; Robert C. L. Day, both of Cambridge, United Kingdom

[73] Assignee: Esselte Dymo N.V., St. Niklaas, Belgium

[21] Appl. No.: 266,819

[22] Filed: Jun. 27, 1994

[30] Foreign Application Priority Data

Jul. 12, 1993 [GB] United Kingdom ..... 9314390

[51] Int. Cl.[6] ..... B41J 11/68

[52] U.S. Cl. ..... 400/621; 400/621.2; 83/613

[58] Field of Search ..... 400/621, 621.2, 400/621.1; 101/26; 83/613

[56] References Cited

U.S. PATENT DOCUMENTS

| | | | |
|---|---|---|---|
| 3,133,495 | 3/1962 | De Man | 400/621 |
| 3,406,805 | 10/1968 | Goodrich | 400/621 |
| 3,757,919 | 9/1973 | Pedersen | 400/621 |
| 3,854,229 | 12/1974 | Morgan | 40/2 |
| 4,815,871 | 3/1989 | McGourty et al. | 400/120 |
| 5,066,152 | 11/1991 | Kuyuya et al. | 400/621 |
| 5,259,681 | 11/1993 | Kitazawa et al. | 400/621 |
| 5,271,789 | 12/1993 | Takagi et al. | 400/621 |

FOREIGN PATENT DOCUMENTS

| | | | |
|---|---|---|---|
| 4185468 | 7/1992 | Japan | 400/621 |

*Primary Examiner*—Edgar S. Burr
*Assistant Examiner*—Anthony H. Nguyen
*Attorney, Agent, or Firm*—Pennie & Edmonds

[57] ABSTRACT

A cutting mechanism for printing tape is described wherein the tape is bent over an arcuate surface during cutting so that when the tape is cut layers of the tape secured to one another by an adhesive layer tend to separate.

15 Claims, 3 Drawing Sheets

TAPE CUTTING APPARATUS

FIELD OF THE INVENTION

The present invention relates to tape cutting apparatus and is particularly but not exclusively concerned with cutting tape used in thermal printing devices.

BACKGROUND TO THE INVENTION

Thermal printing devices of the type with which the present invention is primarily concerned operate with a supply of tape arranged to receive an image and a means for transferring image onto the tape. In one form, a tape holding case holds a supply of image receiving tape and a supply of an image transfer ribbon, the image receiving tape and the transfer ribbon being passed in overlap through a printing zone of the printing device. A printing device operating with a tape holding case of this type is described for example in U.S. Pat. No. 4,815,871 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releaseable backing layer by a layer of adhesive. Once an image or message has been printed on the tape, it is desired to cut off that portion of the tape to enable it to be used as a label. For this purpose, it is necessary to remove the releaseable backing layer from the upper layer to enable the upper layer to be secured to a surface by means of the adhesive layer. With existing printing devices, it is difficult to remove the releaseable backing layer from the upper layer: it is necessary first to separate the closely adhered end portions of the releaseable backing layer and the upper layer, for example using a fingernail or tweezers so that the separated end portion of the releaseable backing layer can be finger gripped to peel it off the adhesive layer. This is a relatively difficult procedure and furthermore can result in the ends of the label being damaged in the process.

There have been several attempts to solve this problem. Most such attempts have sought to rely on the provision of a so-called tab cut. In these devices, a first cut is made completely through all the layers of the tape to cut off a portion of the tape and at the same time a cut is made through only one layer of the tape. This provides a "tab" which, in theory, can be peeled away reasonably easily. While a tab cut has been implemented successfully with relatively thick, stiff upper layers there are significant difficulties in implementing so-called tab cut devices for tapes of the type used in thermal printing devices, where the upper layer is generally a thin resilient polyester material. Although there have been several proposals, no such tab cut has successfully been implemented in a thermal printing device. By way of example, reference is made to U.S. Pat. No. 5,066,152 which describes one attempt to form a tab cut system, where a cut is made only through the backing layer.

Reference is also made to U.S. Pat. No. 5,259,681 which provides a different solution to the problem of enabling the releaseable backing sheet to be removed easily by providing a cutting system which causes the end portions of the tape to separate as a result of forming a bend in the tape before cutting.

SUMMARY OF THE INVENTION

According to the present invention there is provided a tape cutting apparatus for cutting off a portion of tape comprising first and second layers secured one to another by an adhesive layer, the apparatus comprising a cutter support member carrying a blade and being mounted for movement relative to an arcuate tape support surface over which the tape extends during cutting so that when the tape is cut the first and second layers tend to separate from one another at the cut edge.

Preferably, the arcuate support surface is provided by a semi-circular mandrel. The arcuate support surface can be provided by the whole or merely part of the semicircular mandrel.

Preferably, the tape is drawn over the semi-circular mandrel by a clamp which pulls the tape downwards and holds it in place during cutting.

In the preferred embodiment, the semi-circular mandrel has a slot into which the blade moves during cutting.

The invention has the advantage over U.S. Pat. No. 5,259,681 that there is no permanent label deformation. Use of the prior art system is likely to result in a permanent bend mark on the label substrate because they rely on a sharp bend being created in the tape. Moreover, there is no need to position the tape accurately as required in FIGS. 2 and 3 of U.S. Pat. No. 5,259,681 since cutting and bending take place simultaneously.

For a better understanding of the present invention, and to show how the same may be carried into effect, reference will now be made by way of example to the accompanying drawings.

DESCRIPTION OF THE PREFERRED EMBODIMENT

Figure 1:
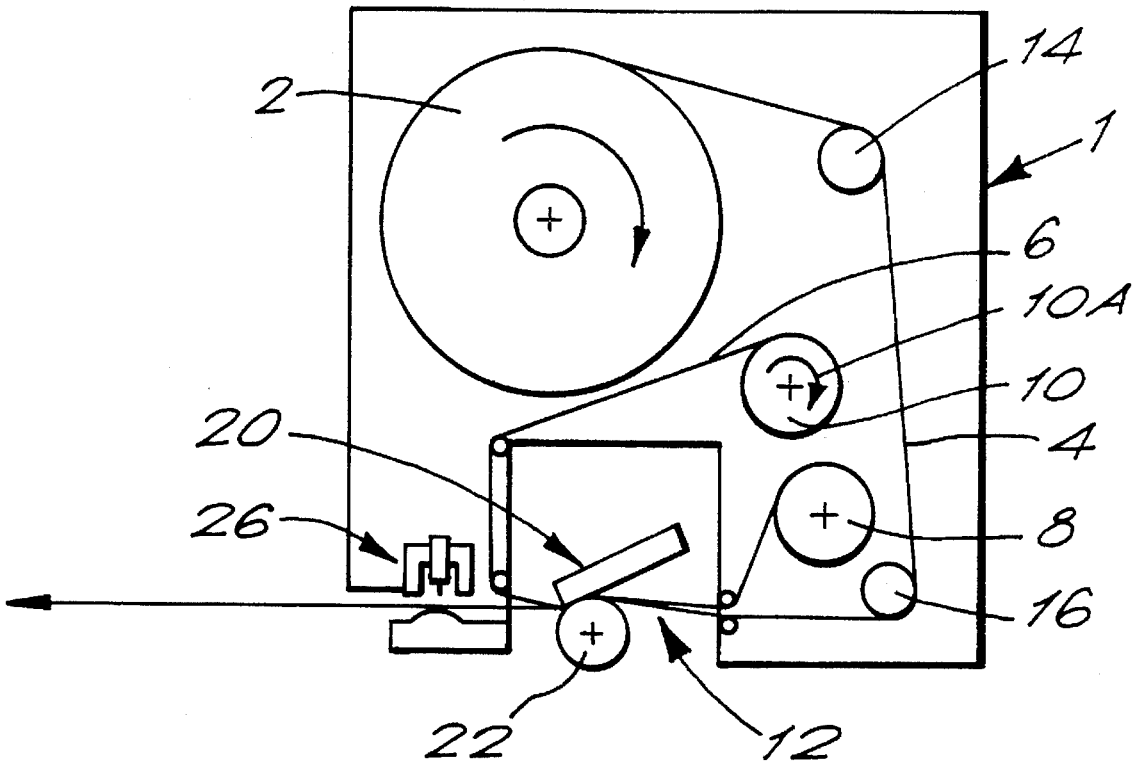
FIG. 1 is a diagrammatic plan view of a tape cassette shown in cooperation with a printing and feed mechanism and a tape cutting apparatus.

In FIG. 1, reference numeral 1 designates a tape holding case or cassette. The tape holding case contains a supply spool 2 of an image receiving tape 4. The image receiving tape comprises an upper layer **4*a* which receives a printed image. The upper layer can for example be polyester or paper and is generally a thin resilient material. The underside of the upper layer is coated with an adhesive layer to which is secured a releaseable backing layer 4*b*. The construction of the image receiving tape 4** is described in more detail hereinafter with reference to the tape cutting apparatus.

The cassette 1 also houses an image transfer ribbon 6. The ribbon 6 extends from a supply spool 8 to a take-up spool 10. The take-up spool 10 is driven as indicated by arrow 10A in a direction to cause the ribbon 6 to be fed from the supply spool 8 to the take-up spool 10 via a print zone generally designated 12. The image receiving tape 4 is also guided through the print zone 12 overlapped with the transfer ribbon 6. Reference numerals 14 and 16 denote guide posts for guiding the image receiving tape 4 through the cassette 1.

The cassette 1 is intended to cooperate with a thermal printing device. The printing device carries a print head 20 and a platen 22. The print head is movable between an operative position shown in FIG. 1 in which it is in contact with the platen 22 and in which the image receiving tape and transfer ribbon are pinched in overlap between the print head and the platen and an inoperative position in which the tapes are released to enable the cassette to be removed. With the print head in contact with the platen, an image is transferred to the image receiving tape as a result of selectively heating pixels on the thermal print head. Such thermal printing devices are known, one example being illustrated in EP-A-0267890. The platen 22 is rotatable to draw the image receiving tape once printed past the print zone and out of the cassette 1. Once a message has been printed, the image receiving tape is fed to a cutting apparatus 26 which may or may not be integral with the cassette.

Figure 2:
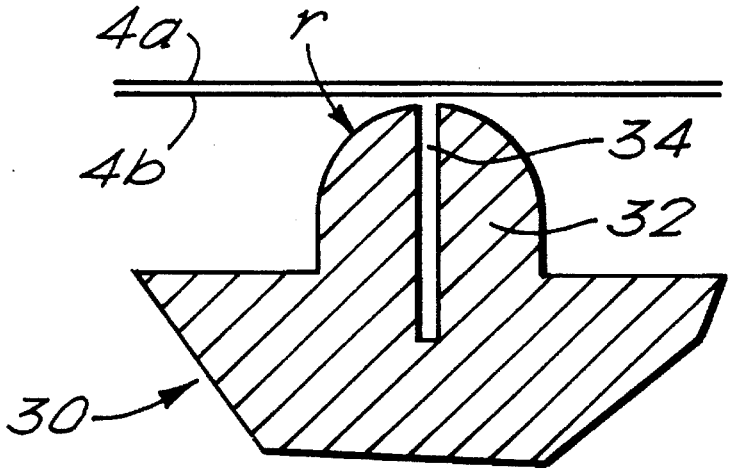
FIGS. 2 to 4 show in cross-section a cutting apparatus in various stages of use.

FIG. 2 shows in cross-section a tape support member of the cutting apparatus 26. The tape support member 30 has a semi-circular mandrel 32. For tape having a width of 12 mm, the cross-sectional radius r is preferably less than about 2.5 mm. The image receiving tape 4 is shown with its image receiving layer 4*a* uppermost and its releaseable backing layer 4*b* adjacent the mandrel. The mandrel has a slot 34 formed therein into which a cutting blade moves during cutting as described later.

Figure 3:
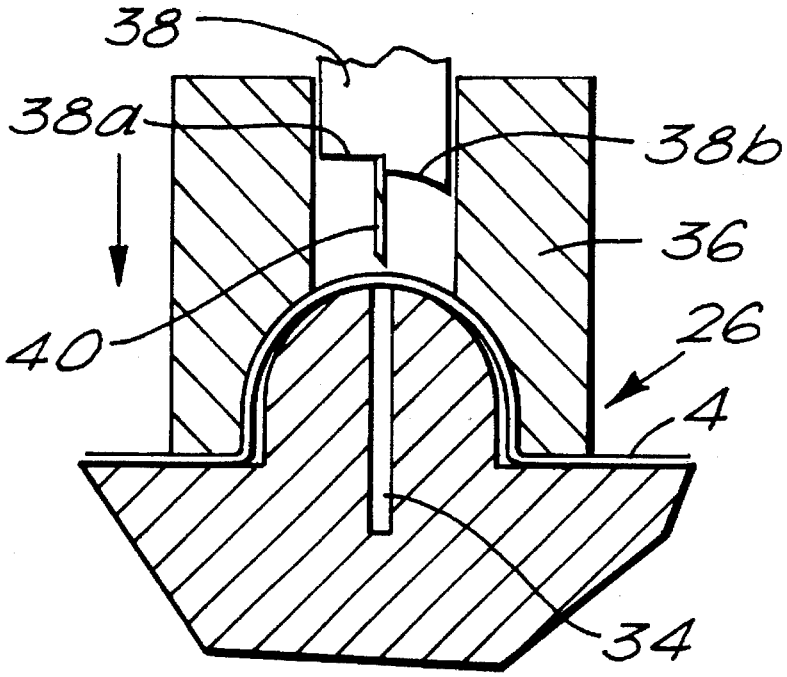

Referring now to FIG. 3, the cutting apparatus 26 also includes a clamp 36 which is slidable in the direction of cutting to pull the tape 4 downwards over the mandrel and to hold it there during cutting as illustrated in FIG. 3. Reference numeral 38 denotes a cutter support member which carries a blade 40. During cutting, the cutter support member 38 is moved toward the tape 4 to cause the blade 40 travel into the slot 34, thus cutting the tape.

Figure 4:
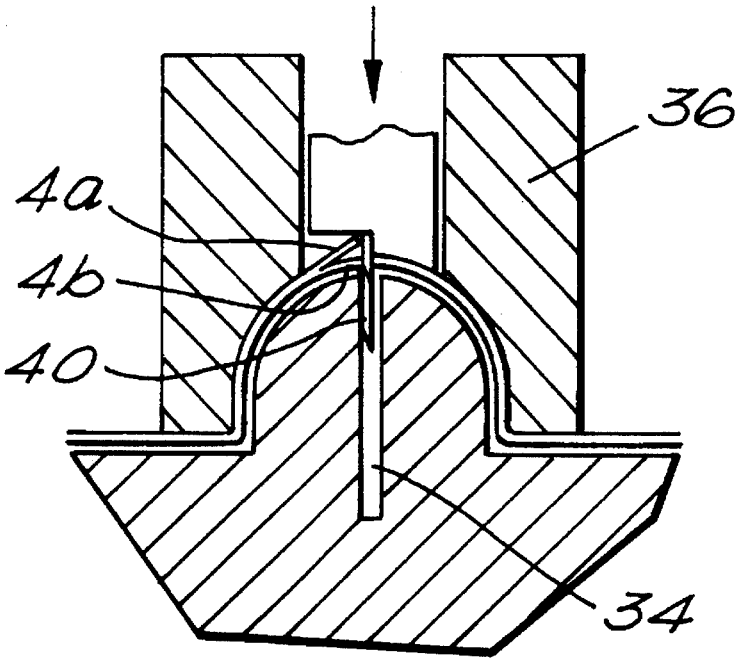

The cutting operation is shown in FIG. 4. That is, the blade 40 has cut the tape 4 and enters the slot 34. Due to the differences in resilience between the backing layer 4*b* and the image receiving layer 4*a*, the backing layer 4*b* stays in place on the mandrel surface while the image receiving layer 4*a* springs upwards, thus tending to separate against the adhesive strength between the image receiving layer and backing layer.

The cutter support member has a lower surface with a flat part 38*a* and a circularly curved part 38*b*. The latter part holds the tape (FIG. 4) to the right hand side of the blade and prevents the layers from separating on the leading edge of the next label.

After cutting, the cutter support member 38 moves upwards and the clamp 36 is released to allow the finished label to be removed.

While the blade is shown moving into a slot 34 in FIGS. 2 to 4, it would equally be possible to implement the invention where the upper surface of the mandrel 32 is continuous and acts as an anvil against which the blade acts. There are however advantages to cutting into a slot, as discussed in our copending Application Ser. No. 08/266,828 filed on even date herewith and incorporated herein by reference.

Whether or not the mandrel has a continuous surface or a slot, the tape should be cut at the apex of the mandrel.

It is possible to dispense with the clamp 36 if the pulling force on the tape is adequate to hold it over the mandrel with a sufficient tension during cutting.

The mandrel can be implemented as part of the cassette wall or as part of the printing device itself or as a separate component altogether.

Figure 5:
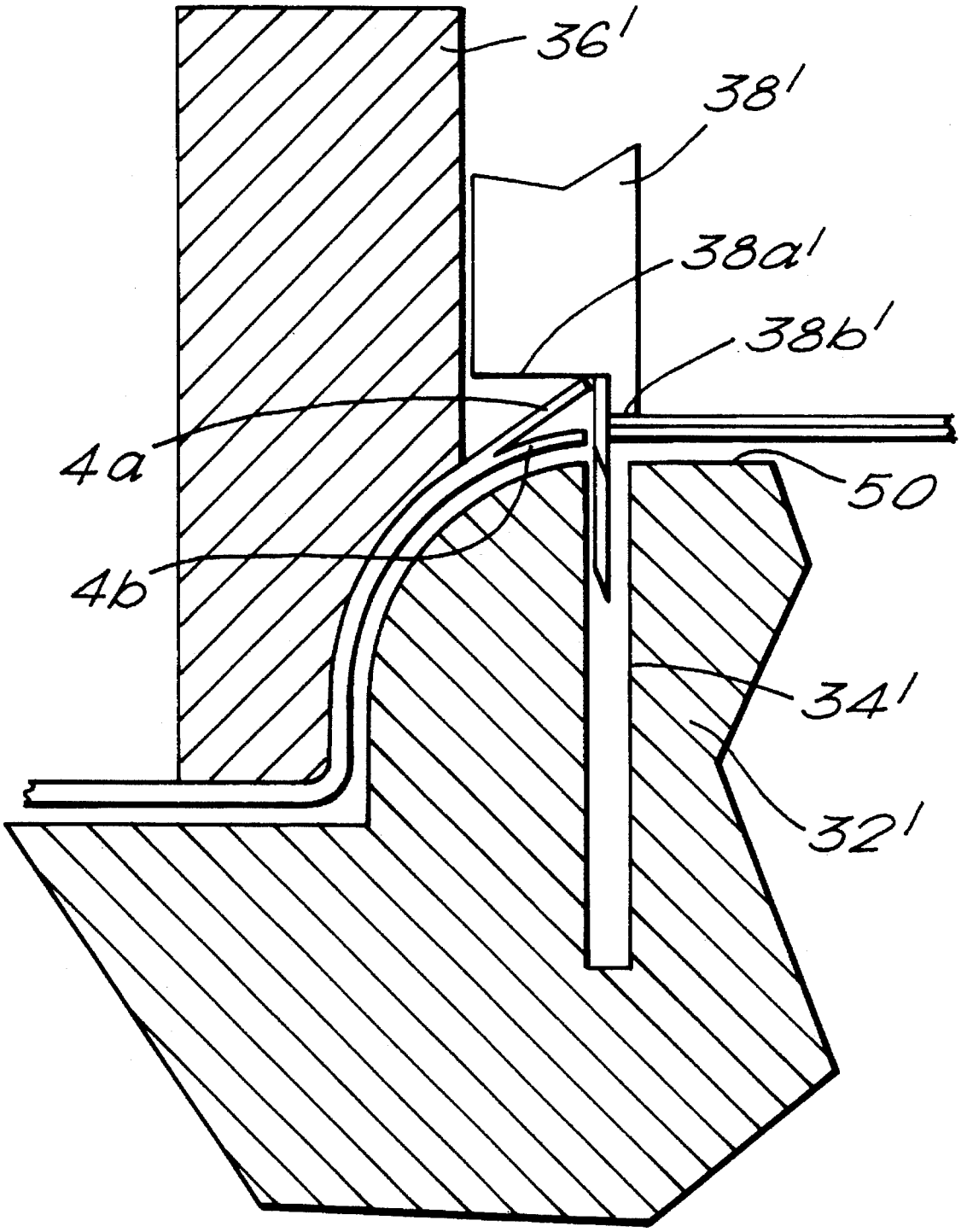
FIG. 5 shows an alternative embodiment of a cutting apparatus.

FIG. 5 represents an alternative embodiment which has operative parts only to the left of the blade 40, thus saving space. Like parts are denoted by like numerals in FIGS. 2 to 4, but primed. The cutter support member 38' has a first flat part 38*a'* and a second flat part 38*b'*, the latter serving to hold the tape against a corresponding flat surface 50 of the "mandrel" 32'. The "mandrel" has a curved surface only to the left of the blade and the clamp 36' serves only to hold the tape against this surface. In other respects, the principle of operation is the same as discussed above.

What is claimed is:

1. A tape cutting apparatus for cutting off a portion of tape, said tape comprising a first and a second layer secured to one another by an adhesive layer, said apparatus comprising:

an arcuate tape support surface for supporting tape during a cutting operation;

a blade mounted for movement between a first position, in which said blade cooperates with the arcuate tape support surface to cut said tape, and a second non-cutting position; and means to cause the first and second layers to tend to separate from one another at a cut edge of the tape, said means including means for pulling the tape downwardly over the arcuate support surface and holding the tape in tension against the arcuate surface during cutting.

2. A tape cutting apparatus as claimed in claim 1 wherein said means for pulling comprises a clamp.

3. A tape cutting apparatus as claimed in claim 2 wherein said clamp comprises two portions, one arranged on either side of said blade and said blade is mounted on a cutter support member which is arranged to move between the two clamp portions.

4. A tape cutting apparatus as claimed in claim 2, wherein said blade is arranged to cut off a portion of tape from a tape store, said blade having a first side which is nearer the tape store and a second side on which the cut-off portion of tape is provided, said clamp being provided on the second side of the blade.

5. Apparatus according to claim 7 wherein the arcuate support surface is provided by a semi-circular mandrel.

6. A tape cutting apparatus as claimed in claim 1, wherein said blade is arranged to cut off a portion of tape from a tape store, said blade having a first side which is nearer the tape store, and a second side on which the cut-off portion of tape is provided, said blade being mounted on a cutter support member which has:

a first curved part on said first side of the blade, said first curved part being held against the arcuate surface when the blade is in said first position; and a second part on the second side of the blade, said second part being spaced apart from the cutting surface when said blade is in the first position, whereby said first curved part prevents the first and second layers from separating on a cut edge of the tape on said first side.

7. A tape cutting apparatus as claimed in claim 1, wherein said blade moves towards the apex of the arcuate surface during the cutting operation.

8. A tape cutting apparatus as claimed in claim 1 or 4 wherein said blade is arranged to cut off a portion of tape from a tape store, said blade having a first side which is nearer the tape store and a second side on which the cut-off portion of tape is provided, said blade being mounted on a cutter support member which has:

a first part on said first side of the blade, said first portion being held against the arcuate surface when the blade is in the first position; and a second part on the second side of the blade, said second part being spaced apart from the cutting surface when said blade is in the first position, wherein said first part prevents the first and second layers from separating on a leading edge of the tape from said tape store, the extent of said first part being less than that of said second part.

9. A tape holding case comprising:

a supply of tape, said tape having first, second and adhesive layers, said first and second layers being secured to one another by said adhesive layer;

an arcuate tape support surface for supporting the tape during a cutting operation, for cooperating with a cutting blade and for causing the first and second layers to tend to separate from one another at a cut edge of the tape, said arcuate support surface operatively associated with external means to hold said tape in tension against said arcuate support surface.

10. Apparatus according to claim 1 or 9 wherein the arcuate support surface includes a slot into which the blade moves during cutting.

11. A printing device comprising:

a cassette receiving bay for receiving a cassette holding tape, the tape of the cassette comprising first, second and adhesive layers, the first and second layers being secured to one another by the adhesive layer;

a printing mechanism for printing on said tape;

an arcuate tape support surface for supporting tape during a cutting operation;

a blade mounted for movement between a first position in which said blade cooperates with the arcuate tape support surface to cut tape and a second non-cutting position; and means to cause the first and second layers to tend to separate from one another at a cut edge of the tape, said means including means for pulling the tape downwardly over the arcuate support surface and holding the tape in tension against the arcuate surface during cutting.

12. A printing device as claimed in claim 11, wherein said means for pulling comprises a clamp.

13. A tape cutting apparatus for cutting off a portion of tape, said tape comprising a first and a second layer secured to one another by an adhesive layer, said apparatus comprising:

a blade arranged to cut off a portion of tape from a tape store, said blade having a first side which is nearer the tape store and a second side on which the cut-off portion of tape is provided, said blade being mounted for movement between a first cutting position and a second non-cutting position;

a tape support surface for supporting tape during a cutting operation, said blade cooperating with said tape support surface during the cutting operation, said tape support surface having an arcuate portion only on the said second side of the blade;

means to cause the first and second layers to tend to separate from one another at a cut edge of the tape, said means including means for pulling the tape downwardly over the tape support surface and holding the tape in tension against the arcuate portion during cutting.

14. A tape cutting apparatus as claimed in claim 13 wherein the tape support surface is substantially planar on the first side of the blade.

15. A tape holding case comprising:

a supply of tape, said tape having first, second and adhesive layers, said first and second layers being secured to one another by said adhesive layer;

a tape support surface for supporting the tape during a cutting operation and a cutting blade for cooperating with said surface, said tape support surface having an arcuate portion substantially only to one side of the cutting blade;

means to cause the first and second layers to tend to separate from one another at a cut edge of the tape, said means including said tape support surface and operatively associated with external means to hold said tape in tension against the support surface during the cutting operation so that said tape to said one side of the blade adopts an arcuate form.

* * * * *